United States Patent [19]

Löffler

[11] 4,314,387

[45] Feb. 9, 1982

[54] DIRT SEPARATOR

[75] Inventor: Walter Löffler, Neubulach, Fed. Rep. of Germany

[73] Assignee: Hollingsworth GmbH, Neubulach, Fed. Rep. of Germany

[21] Appl. No.: 85,811

[22] Filed: Oct. 17, 1979

[30] Foreign Application Priority Data

Oct. 23, 1978 [DE] Fed. Rep. of Germany ..... 2846109

[51] Int. Cl.[3] ..... D01G 15/32

[52] U.S. Cl. ..... 19/98; 19/104; 19/107

[58] Field of Search ..... 19/107, 98, 104, 108, 19/109, 110, 111, 113

[56] References Cited

U.S. PATENT DOCUMENTS

| | | | |
|---|---|---|---|
| 334,872 | 1/1886 | Keene | 19/84 X |
| 3,858,276 | 1/1975 | Hollingsworth | 19/98 |
| 4,011,631 | 3/1977 | Estebanell | 19/100 |
| 4,219,908 | 9/1980 | Winch | 19/107 X |

FOREIGN PATENT DOCUMENTS

| | | | |
|---|---|---|---|
| 1372455 | 4/1964 | France | 19/107 |
| 45-32783 | 10/1970 | Japan | 19/107 |
| 1058894 | 2/1967 | United Kingdom | 19/107 |

*Primary Examiner*—Louis Rimrodt
*Attorney, Agent, or Firm*—Max Fogiel

[57] ABSTRACT

A dirt separator which is arranged between adjacent carding plates of a carding device and which comprises a knife blade and a collecting rail. Each of these elements is radially adjustable with respect to the main cylinder of the carding device. The knife blade, the collecting rail and a cover form a vacuum chamber that is adapted to be connected to a vacuum source. A longitudinal gap or clearance between the knife blade and the collecting rail serves to extract the dirt or trash from the treated material.

9 Claims, 2 Drawing Figures

DIRT SEPARATOR

BACKGROUND OF THE INVENTION

This invention relates to a dirt separator for cards having a cylinder and fixedly mounted carding segments cooperating therewith, comprising a knife blade of which the blade edge is arranged against the direction of rotation of the cylinder at a narrow interval from its clothing adjoining a carding segment.

The disadvantage of known dirt separators of this type is that the separation of short fibres takes place without any control. In addition, the separation of dirt is not effective enough and the dirt separator becomes blocked because, apart from the required particles, fibres are also separated out.

SUMMARY OF THE INVENTION

The object of the present invention is to provide a dirt separator which enables the intensity of cleaning and the type of fibres separated out to be adjusted and which has a wider scope of application, particularly in the carding of cotton.

According to the invention, this object is achieved in that the knife blade is provided with an adjustment for adjusting the interval between the knife blade and the clothing of the cylinder, and in that the knife blade is preceded in the direction of rotation by a collecting rail which has a substantially flat base surface running parallel to the surface of the cylinder.

The interval between the base surface and the cylinder is preferably adjustable. In this way, it is possible to adjust the spectrum of the impurities and short fibres separated out.

According to another aspect of the invention, the clearance between the collecting rail and the edge of the knife blade is also adjustable. In extreme cases, the clearance can be adjusted to zero so that no separation of dirt occurs.

In one particular embodiment, the dirt separator is arranged between two carding segments, the knife blade and the associated adjustment being fixed to one of these carding segments and the collecting rail to the adjacent carding segment. This construction eliminates the need for additional holders for the components of the dirt separator.

The empty space formed between the knife blade and the collecting rail may be closed by a cover. The empty space thus closed may be connected to an extractor so that blocking of the dirt separator is avoided.

The collecting rail preferably has a surface which adjoins the base surface and which faces the knife blade. That part of the surface which adjoins the base surface may run parallel to the plane of movement of the knife blade. In this way, the clearance between the collecting rail and the knife blade is not changed during adjustment of the knife blade.

BRIEF DESCRIPTION OF THE DRAWINGS

One embodiment of the invention is described by way of example in the following with reference to the accompanying diagrammatic drawings, wherein.

DESCRIPTION OF THE PREFERRED EMBODIMENTS

Figure 1:
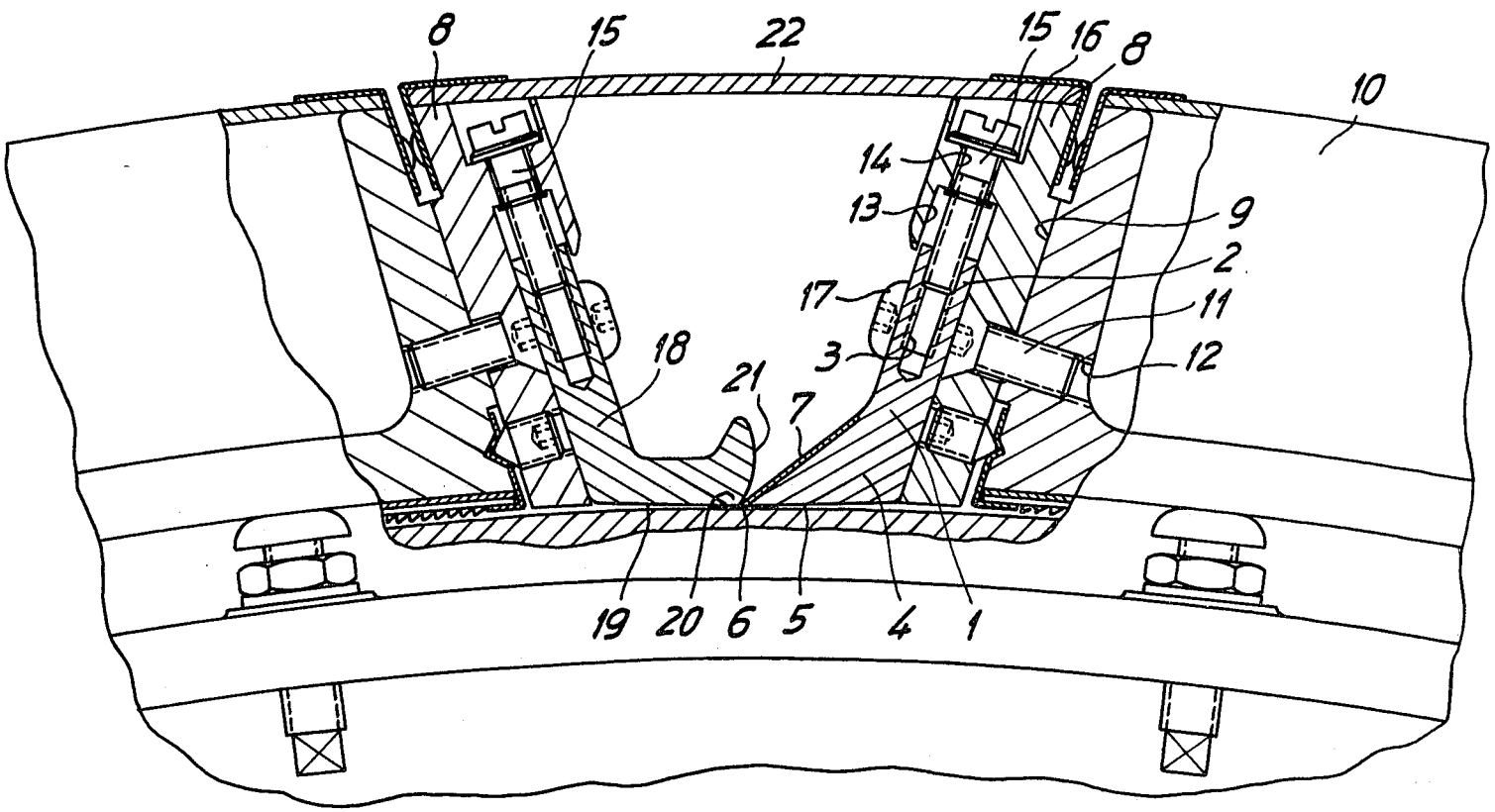
FIG. 1 is a cross-section through the region between two carding segments of a card with a dirt separator arranged in this region.
Figure 2:
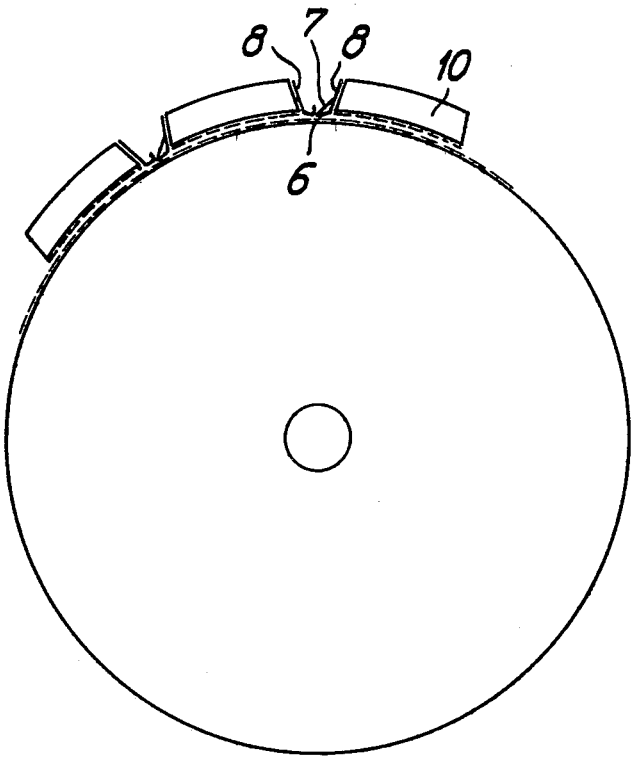
FIG. 2 is a section through a cylinder and three carding segments co-operating therewith.

The dirt separator shown in the drawings comprises a knife blade 1 which has a substantially boot-shaped cross-section and extends over the entire width of a card. The knife blade has a shank 2 into which several screwthreaded holes 3 are cut. The base region 4 of the knife blade 1 has a substantially flat base surface 5 which on one side forms a blade edge 6. In the illustrated embodiment, the blade edge 6 is formed by a blade leaf 7 which is fixed to the base region 4.

The knife blade sits in a holding plate 8 which is screwed to one end 9 of a flat card 10, which forms a carding element, by means of countersunk screws 11 screwed into threaded holes 12 through bores in the holding plate 8.

The holding plate 8 comprises a U-shaped recess 13 which extends over its entire width and of which the dimensions are such that it is able to receive the shank of the knife blade 1 with a sliding fit. The holding plate is formed with bores 14 in alignment with the threaded holes 3. Adjusting screws 15 are inserted through these bores 14, their heads resting on a shoulder 16 of the holding plate 8.

In addition, the shank comprises bores for clamping screws 17 of which the function is to fix the knife blade in position relative to the holding plate 8 once it has been adjusted.

The dirt separator further comprises a collecting rail or trough 18 which has an L-shaped cross-section and which extends over the entire width of the card. The collecting rail 18 comprises a substantially flat base surface 19 which is shaped in such a way that, in the installed position of the collecting rail, it runs parallel to the surface of the cylinder.

That edge 20 of the collecting rail 18 which faces the knife blade 1 may be arranged at a distance from the blade edge 6 of the knife blade 1. To this end, the collecting rail is provided with an adjusting and fixing mechanism identical with that of the knife blade 1. The collecting rail is held by the same holding plate 8 as the knife blade so that the construction of these components is not described again in the following.

As can be seen from FIG. 1, the surfaces of the two holding plates 8, on which the knife blade 1 and the collecting rail 18, respectively, are displaceably arranged, are arranged at an angle to one another. Accordingly, by adjusting the adjusting screws 15, it is possible to adjust not only the distance of these parts from the cylinder, but also the interval between the edge 20 and the blade edge 6.

In the illustrated embodiment, a curved surface 21 adjoins the edge 20 of the collecting rail 18. If that part of this curved surface which immediately adjoins the edge 6 is shaped in such a way that it runs substantially parallel to the plane of movement of the knife blade 1, it is possible by adjusting the knife blade 1 to alter only the distance between the base surface thereof and the cylinder, but not the clearance between the knife blade 1 and the collecting rail 18.

Dirt separators of the type in question may be arranged between all the carding segments of a card and, by appropriate adjustment thereof, it is possible to obtain an optimal separation of impurities, fine dust and fibres.

The interval between the knife blade and the cylinder determines the intensity of separation. With a very narrow interval, very fine dust particles (microdust) are separated out along with husk fragments and short fibres. With a wider interval between the knife blade and the cylinder, less microdust is removed. The adjustment range should be between 0.1 and 2.5 mm.

The position of the collecting rail determines the amount of impurities and short fibres separated in dependence upon the degree of soiling and the staple length of the fibres. In the case of long-staple fibres for example, it is possible by widening the interval between the collecting rail and the cylinder to increase the proportion of short fibres separated out, which also applies to the amount of impurities separated out.

The collecting rail 18 and the knife blade 1 may also be adjusted in such a way that the blade edge 6 touches the collecting rail 18. In this position, there is no separation of dirt or short fibres. This setting is necessary for example for the processing of manmade fibres.

The collecting rail 18 may be adjusted in such a way that the interval between the base surface 19 and the cylinder measures up to 15 mm.

The empty space between the collecting rail 18, the knife blade 1 and the cover 22 is connected to an extractor so that the particles separated out do not block the dirt separator.

I claim:

1. A dirt separator for cards having a cylinder with clothing and fixedly mounted carding segments cooperating therewith, comprising: a knife blade having a blade edge arranged against the direction of rotation of the cylinder at a narrow interval from its clothing adjoining a carding segment, said knife blade having adjustment means for adjusting the interval between the knife blade and the clothing of the cylinder, a collecting rail having a substantially flat base surface running parallel to the surface of the cylinder; said knife blade being preceded in the direction of rotation by said flat base surface of said collecting rail, said collecting rail having radial adjustability, said dirt separator being arranged at the outlet end of a carding flat.

2. A dirt separator as claimed in claim 1, wherein the interval between the base surface and the cylinder is adjustable.

3. A dirt separator as claimed in claim 1, wherein a clearance is formed between the collecting rail and edge of the knife blade, said clearance being adjustable.

4. A dirt separator as claimed in claim 1 and arranged between two carding segments, said knife blade and associated adjustment means being fixed to one carding segment, said collecting rail being fixed to the adjacent carding segment.

5. A dirt separator as claimed in claim 1, wherein an empty space formed between said knife blade and said collecting rail, and a cover for closing said empty space.

6. A dirt separator as claimed in claim 1, wherein said collecting rail has a surface adjoining said flat base surface and facing the knife blade.

7. A dirt separator as claimed in claim 6, wherein part of said surface adjoining said flat base surface runs parallel to the plane of movement of said knife blade.

8. A dirt separator as defined in claim 1, wherein the interval between the base surface and the cylinder is adjustable, a clearance being formed between said collecting rail and edge of the knife blade, said clearance being adjustable, said dirt separator being arranged between two carding segments, said knife blade and associated adjustment means being fixed to one carding segment, said collecting rail being fixed to the adjacent carding segment, an empty space being formed between said knife blade and said collecting rail, and a cover for closing said empty space, said collecting rail having a surface adjoining said flat base surface and facing the knife blade, part of said surface adjoining said flat base surface running parallel to the plane of movement of said knife blade, said knife blade having a substantially boot-shaped cross-section and extending over the entire width of a card, said knife blade having a shank with a plurality of threaded holes, said knife blade having a base region with a substantially flat base surface forming on one side a blade edge, comprised of a blade leaf fixed to said base region, a holding plate for seating said knife blade, said holding plate being attached to one end of a flat card forming a carding element, said holding plate having a U-shaped recess extending over the entire width of said holding plate, said recess receiving the shank of said knife blade with a sliding fit, said holding plate having bores aligned with said threaded holes, adjusting screws inserted through said bores and having heads resting on a shoulder of said holding plate, said shank having bores for clamping screws to fix said knife blade in position relative to said holding plate after adjustment, said collecting rail having an L-shaped cross-section and extending over the entire width of the card, said collecting rail being held also by said holding plate, said adjusting screws adjusting the distance of said knife blade and said collecting rail from said cylinder, said adjusting screws also adjusting said clearance between an edge of said collecting rail and edge of said knife blade, said collecting rail having a curved surface adjoining said edge of said collecting rail, a part of said curved surface immediately adjoining said edge of said knife blade being shaped so that it runs substantially parallel to the plane of movement of said knife blade, the interval between the knife blade and the cylinder determining the intensity of separation whereby fine particles are separated out with short fibers by relatively narrow interval and reduced particles being removed by a wider interval, the adjustment range being substantially between 0.1 and 2.5 mm, the position of said collecting rail determining the amount of impurities and short fibers separated in dependence upon the degree of soiling and the staple length of fibers, said collecting rail being adjustable so that the interval between said base surface of said collecting rail and the cylinder may be increased to 15 mm, said empty space being connectable to a suction source for preventing particles separated out from blocking the dirt separator.

9. A dirt separator as defined in claim 1, and arranged between two carding segments, said knife blade and associated adjustment means being fixed to one carding segment, said collecting rail being fixed to the adjacent carding segment, a vacant space being formed between said knife blade and said collecting rail, and cover means for closing said vacant space, said vacant space comprising a suction chamber.

* * * * *